US009500205B2

(12) United States Patent
Higashimori et al.

(10) Patent No.: US 9,500,205 B2
(45) Date of Patent: Nov. 22, 2016

(54) MULTI-PRESSURE RADIAL TURBINE SYSTEM

(75) Inventors: Hirotaka Higashimori, Nagasaki (JP); Norihiro Fukuda, Tokyo (JP); Masayuki Kawami, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 501 days.

(21) Appl. No.: 14/002,468

(22) PCT Filed: Jul. 5, 2012

(86) PCT No.: PCT/JP2012/067168

§ 371 (c)(1),
(2), (4) Date: Aug. 30, 2013

(87) PCT Pub. No.: WO2013/011842

PCT Pub. Date: Jan. 24, 2013

(65) Prior Publication Data

US 2013/0336768 A1 Dec. 19, 2013

(30) Foreign Application Priority Data

Jul. 20, 2011 (JP) ..... 2011-159268

(51) Int. Cl.
*F04D 31/00* (2006.01)
*F04D 29/58* (2006.01)
(Continued)

(52) U.S. Cl.
CPC ..... *F04D 29/58* (2013.01); *F01D 9/026* (2013.01); *F01K 7/18* (2013.01); *F01K 25/08* (2013.01); *F22B 33/14* (2013.01)

(58) Field of Classification Search
USPC ..... 415/116, 38, 50, 101, 103; 60/39.161, 60/39.17, 39.182, 39.465, 39.52, 39.53,
(Continued)

(56) References Cited

U.S. PATENT DOCUMENTS 4,183,719 A 1/1980 Bozung
4,229,257 A * 10/1980 Forster ..... G21D 5/06 376/391
(Continued)

FOREIGN PATENT DOCUMENTS

CN 101806232 8/2010
FR 1108442 1/1956
(Continued)

OTHER PUBLICATIONS

Written Opinion of the International Searching Authority issued Aug. 28, 2012 in International Application No. PCT/JP2012/067168 with English translation.
(Continued)

*Primary Examiner* — Binh Q Tran
(74) *Attorney, Agent, or Firm* — Wenderoth, Lind & Ponack, L.L.P.

(57) ABSTRACT

A multi-pressure radial turbine system including a high-pressure pump and a low-pressure pump for pressurizing liquid-phase heating media introduced therein to different pressures; a high-pressure evaporator and a low-pressure evaporator for vaporizing the liquid-phase heating media delivered from the high-pressure pump and the low-pressure pump by absorbing heat from a high-temperature heat source; one multi-pressure radial turbine that expands the gaseous heating media having different pressures and temperatures, supplied from the high-pressure evaporator and the low-pressure evaporator, to obtain output power; and a condenser for condensing the gaseous heating medium expanded in the multi-pressure radial turbine by making the medium release heat to a low-pressure heat source. A cycle circuit is formed through which the heating medium circulates while repeatedly changing its state between vapor and liquid.

14 Claims, 5 Drawing Sheets

(51) Int. Cl.

| | |
|---|---|
| ***F01K 7/18*** | (2006.01) |
| ***F01D 9/02*** | (2006.01) |
| ***F22B 33/14*** | (2006.01) |
| ***F01K 25/08*** | (2006.01) |

(58) Field of Classification Search
USPC ..... 60/39.55
See application file for complete search history.

(56) References Cited

U.S. PATENT DOCUMENTS

| | | | | |
|---|---|---|---|---|
| 5,809,768 | A * | 9/1998 | Uematsu | F01K 25/005 60/39.465 |
| 6,003,298 | A * | 12/1999 | Horner | F01D 17/145 60/39.182 |
| 7,961,835 | B2 * | 6/2011 | Keller | F01K 3/181 376/317 |
| 7,966,840 | B2 * | 6/2011 | Shibata | B01D 19/0068 62/238.6 |
| 8,631,657 | B2 * | 1/2014 | Hagen | B60H 1/032 237/12.1 |
| 2007/0180826 | A1 | 8/2007 | Sumser et al. | |

FOREIGN PATENT DOCUMENTS

| | | |
|---|---|---|
| JP | 52-81449 | 7/1977 |
| JP | 54-106745 | 8/1979 |
| JP | 56-135718 | 10/1981 |
| JP | 58-114844 | 8/1983 |
| JP | 61-3996 | 1/1986 |
| JP | 61-202601 | 12/1986 |
| JP | 63-302134 | 12/1988 |
| JP | 1-277627 | 11/1989 |
| JP | 2007-192127 | 8/2007 |
| JP | 2007-192129 | 8/2007 |
| JP | 2008-503685 | 2/2008 |
| JP | 2008-255959 | 10/2008 |
| JP | 2012-149541 | 8/2012 |
| WO | 2006/117072 | 11/2006 |
| WO | 2008/125827 | 10/2008 |

OTHER PUBLICATIONS

International Search Report issued Aug. 28, 2012 in International Application No. PCT/JP2012/067168.
Extended European Search Report issued Feb. 19, 2015 in corresponding European patent application No. 12815331.9.
Decision to Grant a Patent issued Mar. 31, 2015 in corresponding Japanese patent application No. 2011-159268.

* cited by examiner

MULTI-PRESSURE RADIAL TURBINE SYSTEM

BACKGROUND OF THE INVENTION

1. Technical Field

The present invention relates to a multi-pressure radial turbine system that recovers energy from a low- or intermediate-temperature fluid and a high-temperature, high-pressure fluid and converts the energy into rotational power.

2. Description of the Related Art

In conventional power generation, energy is recovered from a low- or intermediate-temperature fluid and a high-temperature, high-pressure fluid, the energy is converted into rotational power, and the rotational power is used to drive a generator. Known generation systems of this type include, for example, a binary-cycle power-generation system (hereinbelow referred to as a "binary power generator"). Even when, for example, geothermal power generation is impossible because the temperature and pressure under the ground are low and hence it is only possible to obtain hot water, this binary power generator boils a medium having a lower boiling point than water (a low-boiling point fluid), such as ammonia, pentane, or chlorofluorocarbon, using the hot water to rotate a turbine with the vapor of the low-boiling point fluid.

A conventional binary power generator will be briefly described with reference to FIGS. 7 and 8.

FIG. 7 is a block diagram showing a configuration example of a binary power generator Ba. In the illustrated binary power generator Ba, a cycle circuit, through which a heating medium circulates while repeatedly changing its state, includes a pump 11 for pressurizing the heating medium, an evaporator 13 that receives heat from a high-temperature heat source and vaporizes the heating medium, a turbine 15 that expands the high-pressure, high-temperature heating medium vapor and converts the heat energy into rotational power, and a condenser 17 that condenses the low-temperature heating medium, resulting after expanding and releasing its energy, into liquid again. These devices are connected by pipes to form a closed circuit.

In this case, air or water at atmospheric temperature, such as air, river water, or sea water, is used as a low-temperature heat source (temperature level TC) that absorbs heat in the condenser 17. Furthermore, in ocean heat energy conversion (OTEC), low-temperature sea water near the seabed is used as the low-temperature heat source.

On the other hand, examples of the high-temperature heat source (temperature level TW) include high-temperature, high-pressure fluids discharged from various industrial plants, fluids discharged from ship or vehicle power sources, such as exhaust gas, and heat source fluids used in geothermal power generation and ocean heat energy conversion. When the temperature level of the high-temperature heat source, TW, is about several tens to 200° C., a chlorofluorocarbon, a chlorofluorocarbon substitute, a next-generation chlorofluorocarbon, or an organic medium having a critical temperature of approximately 100° C. to 200° C. is used as the heating medium, and at higher temperatures, water is used.

The T-S diagram in FIG. 8 shows a saturation line of the above-described heating medium.

The output of the turbine 15 obtained by the illustrated cycle is used as power-generation motive power for driving the generator 19. That is, the heating medium circulating while exchanging heat with the high-temperature heat source at the temperature level TW and with the low-temperature heat source at the temperature level TC expands in the turbine 15 (expansion), where it does work, i.e., drives the generator 19, and this work is used as electric power.

Accordingly, it is designed to generate maximum electric power using the illustrated binary cycle when a high-temperature heat source having a low or intermediate temperature and a low-temperature heat source are given, and the main parameters are the evaporating pressure P1 and the condensing pressure P2 of the heating medium. Selecting appropriate pressure settings of the evaporating pressure P1 and the condensing pressure P2 is usually performed in industrial processes.

Furthermore, in a radial turbine using a swirling fluid that has a radial flow velocity component as the main component and that flows into a turbine wheel and axially discharging the flow resulting after converting the swirling energy of the flow into the rotational power and releasing energy, the fluid pressure is split into a plurality of flow paths in the turbine, each of the flow paths is provided with a turbine rotor blade inlet, and the radii of the turbine rotor blade inlets are differentiated from one another (see Japanese Unexamined Patent Application, Publication No. Sho 63-302134; Japanese Translation of PCT International Application, Publication No. 2008-503685; and Japanese Unexamined Utility Model Application, Publication No. Sho 61-202601).

SUMMARY OF THE INVENTION

1. Technical Problem

Typically, the temperature level, TW, of the above-described high-temperature heat source, such as exhaust heat, surplus heat, or geothermal heat, is low (e.g., several tens of ° C. to several hundreds of ° C.). Thus, when forming a heat cycle (binary cycle) using the heat medium between the high-temperature heat source and a low-temperature heat source having a temperature level TC of several ° C. to several tens of ° C., such as sea water, river water, or air, it is difficult to obtain high efficiency because of the small temperature difference between the high-temperature heat source and the low-temperature heat source.

More specifically, binary power generation, in which power is generated by converting heat energy into shaft power, has the problem of poor generation efficiency due to the small temperature difference between the high-temperature heat source and the low-temperature heat source. That is, although no fuel cost is required because the heat source itself (e.g., exhaust heat or geothermal heat) is discharged without being used, binary power generation, which uses this low-temperature heat source as the high-temperature heat source, has a disadvantage in that it is not cost effective enough for the capital investment required.

Due to this background, it is necessary to increase the efficiency of the binary power generating system by increasing the generation output and to reduce the cost of the power generator.

The present invention has been made to overcome the above-described problems, and an object thereof is to provide a multi-pressure radial turbine system that can increase the efficiency and reduce the cost of a binary power generating system or the like using a Rankine-cycle. Specifically, the present invention provides a Rankine cycle that has a plurality of heating-medium evaporation temperature settings to obtain a high output from the turbine, and a multi-pressure radial turbine system that can realize this Rankine cycle with a simple structure.

2. Solution to the Problem

To overcome the above-described problems, the present invention employs the following solutions.

A multi-pressure radial turbine system of the present invention includes a plurality of pumps for pressurizing liquid-phase heating media introduced therein to different pressures; a plurality of evaporators for vaporizing the liquid-phase heating media delivered from the pumps by absorbing heat from a first heat source; one multi-pressure radial turbine that expands the gaseous heating media having different pressures and temperatures, supplied from the evaporators, to obtain output power; and a condenser for condensing the gaseous heating medium expanded in the multi-pressure radial turbine by making the medium release heat to a second heat source having a lower temperature than the first heat source, wherein a cycle circuit through which the heating medium circulates while repeatedly changing its state between vapor and liquid is formed.

In this multi-pressure radial turbine system, by dividing a process of releasing heat from the first heat source (one high-temperature heat source) into a plurality of steps, a multi-pressure Rankine cycle, in which heat is released to the liquid-phase heating media in the plurality of evaporators, can be formed. Compared with the outlet temperature of the high-temperature heat source in a single-pressure Rankine cycle, the temperature can be changed to an even lower level. Accordingly, the multi-pressure Rankine cycle can give a greater amount of the heat energy of the high-temperature heat source to the Rankine cycle than the single-pressure cycle.

In the above-described invention, it is preferable that a flow path of the first heat source connect the plurality of evaporators in series, making the first heat source flow from a high-pressure side to a low-pressure side of the liquid media delivered from the pumps. By doing so, the heat of the first heat source can be efficiently used.

In the above-described invention, it is preferable that the multi-pressure radial turbine include one turbine wheel that rotates in a casing, the turbine wheel being a multi-pressure radial turbine or mixed-flow turbine that radially introduces the gaseous media at different pressures, having a plurality of turbine inlets, and having one turbine outlet through which the expanded gaseous medium is discharged in an axial direction.

In this case, the turbine inlets may be arranged such that a plurality of gaseous-medium introduction inlet pressures are gradually lowered toward the turbine outlet, or such that the plurality of gaseous-medium introduction inlet pressures are gradually increased toward the turbine outlet.

In the above-described invention, by configuring the multi-pressure radial turbine such that the multi-pressure radial turbine drives a generator to generate power, a multi-pressure radial-turbine generation system that achieves increased efficiency and reduced cost of the binary power generating system using a Rankine cycle may be formed.

3. Advantageous Effects of the Invention

According to the above-described present invention, it is possible to provide a cycle having a plurality of heating-medium evaporation temperature settings, and a multi-pressure radial turbine system that can realize this cycle with a simple structure. This multi-pressure radial turbine system provides a significant advantage in that it is possible to increase the efficiency and reduce the cost of the binary power generating system.

DETAILED DESCRIPTION OF THE INVENTION

An embodiment of a multi-pressure radial turbine system of the present invention will be described below on the basis of the drawings.

Figure 1:
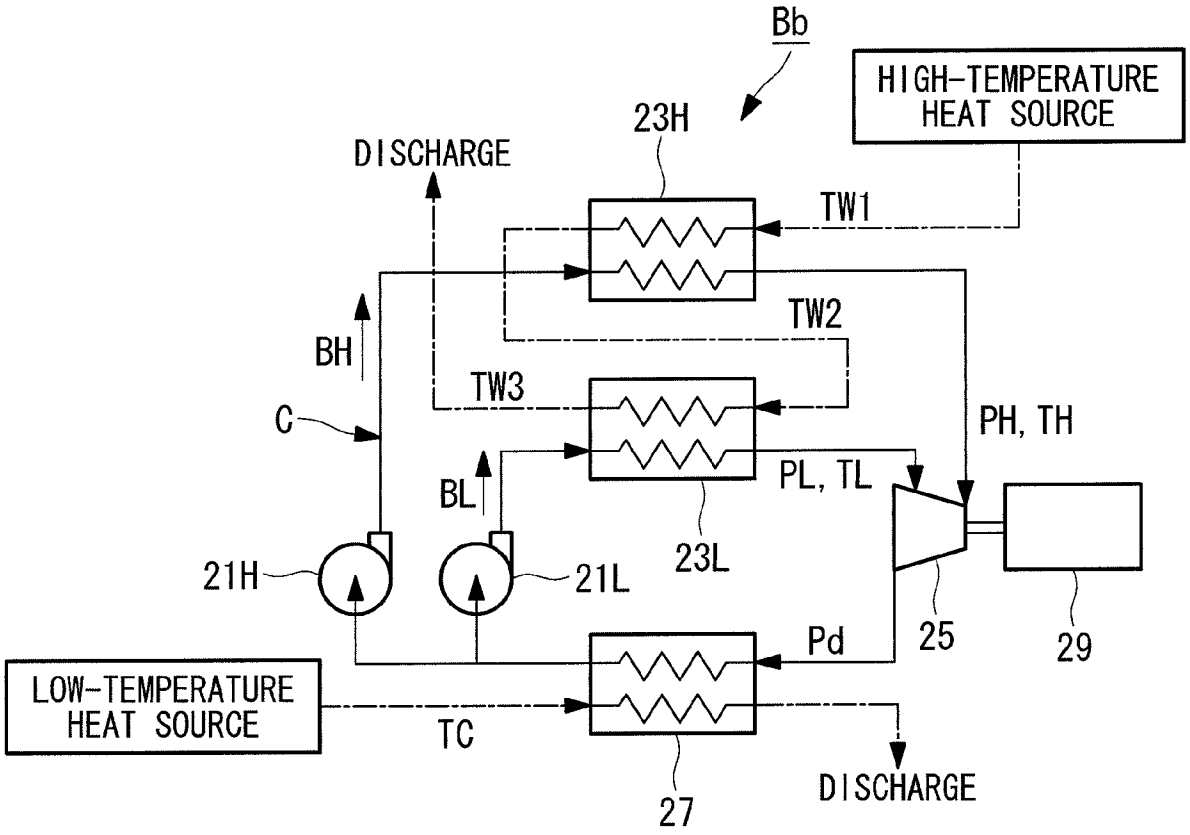
FIG. 1 is a block diagram showing a configuration example of a dual-pressure binary-cycle power-generation system, which is an embodiment of a multi-pressure radial turbine system of the present invention.
Figure 2:
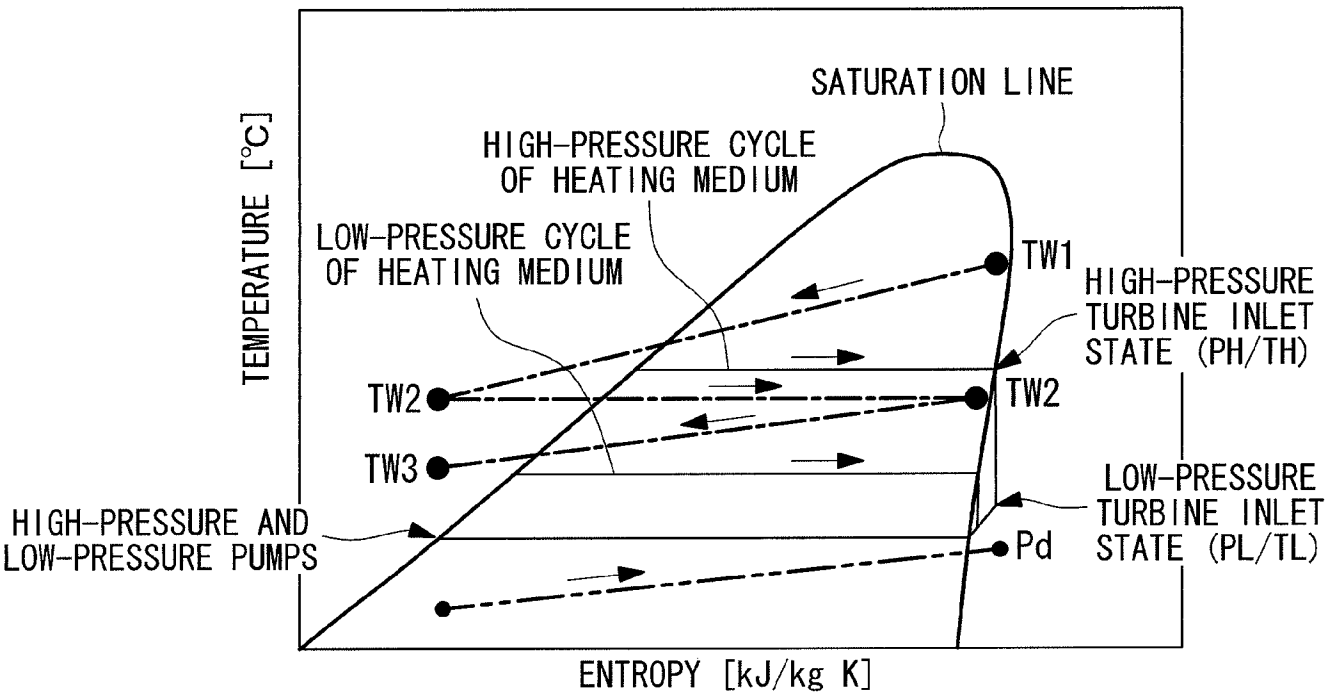
FIG. 2 is a T-S diagram of the dual-pressure binary-cycle power-generation system shown in FIG. 1.

FIG. 1 is a block diagram showing a configuration example of a dual-pressure binary-cycle power-generation system (hereinbelow referred to as "dual-pressure binary-power generator"), which is an example of a multi-pressure radial turbine system, and FIG. 2 is a T-S diagram of the dual-pressure binary-power generator. An illustrated dual-pressure binary-power generator Bb has a Rankine-cycle-based cycle circuit C configured such that a heating medium is circulated at two pressures and temperatures and repeatedly changes its state between liquid and vapor.

The cycle circuit C includes a high-pressure pump 21H and a low-pressure pump 21L for pressurizing a liquid heating medium (liquid medium); a high-pressure evaporator 23H and a low-pressure evaporator 23L that receive heat from a high-temperature heat source (first heat source) and vaporize the heating medium (gaseous medium); a multi-pressure radial turbine 25 that expands two types of high-pressure, high-temperature gaseous media, having different pressures and temperatures, to convert the heat energy into rotational power; and a condenser 27 that makes a low-temperature heating medium (gaseous medium or vapor-and-liquid two-phase medium), resulting after expanding and releasing its energy in the multi-pressure radial turbine 25, release heat to a low-temperature heat source (second heat source) to condense the low-temperature heating medium back into liquid. These devices are connected by pipes, forming a closed circuit.

A generator 29 is connected to an output shaft of the multi-pressure radial turbine 25. Thus, the output of the multi-pressure radial turbine 25 is used as power-generation motive power for driving the generator 29.

The liquid medium condensed in the condenser 27 is introduced into the high-pressure pump 21H and the low-pressure pump 21L and is pressurized to different pressures. In this case, the high-pressure pump 21H pressurizes the liquid medium introduced therein to a high pressure BH and delivers the medium to the high-pressure evaporator 23H, and the low-pressure pump 21L pressurizes the liquid medium introduced therein to a low pressure BL and delivers the medium to the low-pressure evaporator 23L.

The high-pressure evaporator 23H evaporates (vaporizes) a liquid medium at the heat-absorbing side into a high-pressure gaseous medium having a pressure PH and a temperature TH through heat exchange between the liquid medium having the high pressure BH, pumped by the high-pressure pump 21H, and a high-temperature-heat-source fluid having a heat source temperature TW1, supplied from the high-temperature heat source.

The low-pressure evaporator 23L evaporates (vaporizes) the liquid medium at the heat-absorbing side into a low-pressure gaseous medium having a pressure PL and a temperature TL through heat exchange between the liquid medium having the low pressure BL, pumped by the low-pressure pump 21L, and a high-temperature-heat-source fluid having a heat source temperature TW2, supplied from the high-pressure evaporator 23H. That is, in a flow path of the high-temperature-heat-source fluid supplied from the high-temperature heat source, the high temperature evaporator 23H and the low-temperature evaporator 23L are connected in series, and the low-pressure evaporator 23L introduces the high-temperature-heat-source fluid that has been reduced in temperature from TW1 to TW2 as a result of heat exchange in the high temperature evaporator 23H to use it in heat exchange.

The high-pressure gaseous medium supplied from the high-pressure evaporator 23H and the low-pressure gaseous medium supplied from the low-pressure evaporator 23L expand in the multi-pressure radial turbine 25 and release energy. In the multi-pressure radial turbine 25, the energy released from the high-pressure gaseous medium and the low-pressure gaseous medium rotates the turbine and is converted into rotational power. Note that, in the dual-pressure binary-power generator Bb, the rotational power of the multi-pressure radial turbine 25 serves as the driving power for driving the generator 29 to generate power.

This multi-pressure radial turbine 25 is an expansion turbine formed of a dual-pressure radial turbine that integrates a high-pressure turbine that expands a high-pressure gaseous medium to convert the energy into rotational power and a low-pressure turbine that expands a low-pressure gaseous medium to convert the energy into rotational power.

The high-pressure gaseous medium and the low-pressure gaseous medium after expanding and doing work in the multi-pressure radial turbine 25, both in the form of gaseous media with reduced temperature and pressure, meet in the turbine and are guided from a turbine outlet to the condenser 27.

The gaseous medium introduced into the condenser 27 has its heat absorbed by exchanging heat with the low-temperature heat source and is condensed into a liquid medium. This liquid medium is introduced into the high-pressure pump 21H and the low-pressure pump 21L to be pressurized to different pressures and circulates in the cycle circuit C while repeatedly changing its state in the same way.

This type of dual-pressure binary-power generator Bb may employ a heating medium such as a type-1 chlorofluorocarbon, a chlorofluorocarbon substitute, a next-generation chlorofluorocarbon, or an organic medium.

On the other hand, an example of the high-temperature heat source (first heat source) that heats the heat source fluid is a heat source fluid that has the temperature level TW1 and substantially constant specific heat and is supplied from the exhaust heat of a plant, surplus heat, or geothermal heat.

Furthermore, an example of the low-temperature heat source (second heat source) that absorbs heat in the condenser 27 and has the temperature level TC is air at atmospheric temperature or water at ordinary temperature, such as air, river water, or sea water.

Note that, in ocean heat energy conversion, warm water at the ocean surface is used as the high-temperature heat source, and cold water in the deep ocean is used as the low-temperature heat source.

Figure 5:
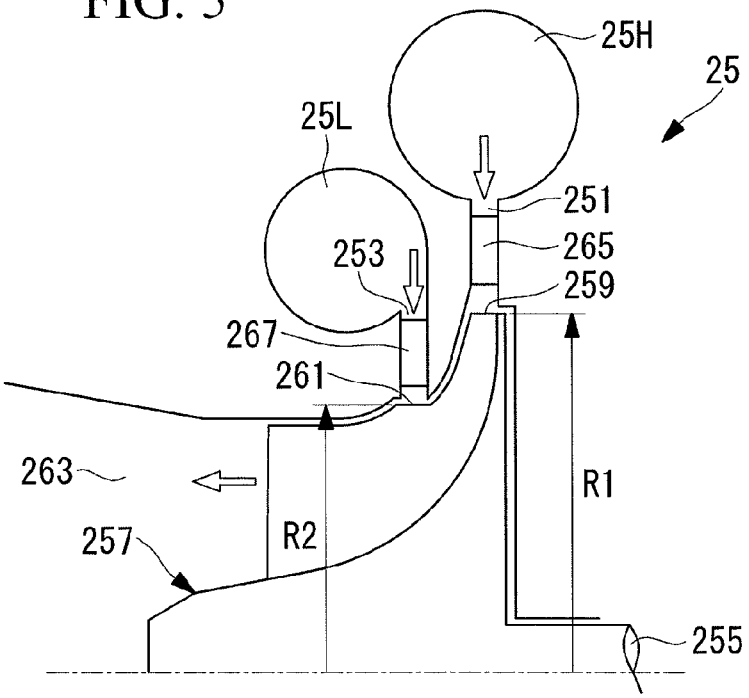
FIG. 5 is a cross-sectional view showing a configuration example of the relevant part (the shape in the meridional plane) of a dual-pressure radial turbine with one rotor blade, serving as a first configuration example of the multi-pressure radial turbine.

Now, a first configuration example, serving as a configuration example of the multi-pressure radial turbine 25, in which two gaseous-medium introduction pressures are arranged so as to be gradually lowered toward the turbine outlet will be described on the basis of FIG. 5.

The illustrated multi-pressure radial turbine 25 has a high-pressure turbine inlet 251 that constitutes a high-pressure turbine 25H, a low-pressure turbine inlet 253 that constitutes a low-pressure turbine 25L, and one radial turbine wheel 257 provided on one rotating shaft 255. This radial turbine wheel 257 is supported in a casing so as to be rotatable.

Note that the radial turbine wheel 257 may be either a radial turbine wheel or a mixed-flow turbine wheel.

The radial turbine wheel 257 has two turbine wheel inlets, i.e., a high-pressure turbine wheel inlet 259 and a low-pressure turbine wheel inlet 261, and one turbine outlet 263.

The high-pressure turbine wheel inlet 259 is formed to have a radius R1. Furthermore, the low-pressure turbine wheel inlet 261 is formed to have a radius R2, which is smaller than the radius of the high-pressure turbine wheel inlet, R1, such that a flow can enter from a part of a turbine blade shroud constituting flow paths in the radial turbine wheel 257 (R1>R2).

A high-pressure nozzle 265 that gives a tangential velocity in a turbine-wheel rotating direction to the flow at the high-pressure turbine inlet 251 is provided on the radially outer circumference of the high-pressure turbine wheel inlet 259. Similarly, a low-pressure nozzle 267 that gives a tangential velocity in the turbine-wheel rotating direction to the flow at the low-pressure turbine inlet 253 is provided on the radially outer circumference of the low-pressure turbine wheel inlet 261.

That is, in the high-pressure turbine 25H, the high-pressure gaseous medium flowing from the high-pressure turbine inlet 251 increases its tangential velocity as it passes through the high-pressure nozzle 265 and flows out of the high-pressure turbine wheel inlet 259 toward the turbine blades of the radial turbine wheel 257, and in the low-pressure turbine 25L, the low-pressure gaseous medium flowing from the low-pressure turbine inlet 253 increases its tangential velocity as it passes through the low-pressure nozzle 267 and flows out of the low-pressure turbine wheel inlet 261 toward the turbine blades of the radial turbine wheel 257.

After the flow rate of the heating medium flowing from the high-pressure turbine inlet and the flow rate of the heating medium flowing from the low-pressure turbine inlet are merged in the turbine, the high-pressure gaseous heating medium and the low-pressure gaseous medium injected at the radial turbine wheel 257 flow out of the outlet of the radial turbine wheel 257 into the turbine outlet 263. The high-pressure gaseous heating medium and the low-pressure gaseous medium passing through the multi-pressure radial turbine 25 in this manner expand in the turbine and do work by rotating the radial turbine wheel 257.

Furthermore, the condenser 27 serving as a heat exchanger, in which the heating medium is made to release (radiate) heat to the low-temperature heat source and is condensed, is provided on the downstream side of the turbine outlet 263.

The high-pressure pump 21H for pressurizing the liquefied heating medium to a pressure at which it is supplied to a first heat exchanger and the low-pressure pump 21L for pressurizing the heating medium to a pressure at which it is supplied to a second heat exchanger are provided on the downstream side of the condenser 27.

The dual-pressure binary-power generator Bb having the above-described configuration includes the multi-pressure radial turbine 25 that expands the heating media having two pressures to convert the heat energy into rotational power using one radial turbine wheel 257, through two heat-receiving processes, and by forming a Rankine cycle, the rotational power output from the multi-pressure radial turbine 25 is used as the rotational power source of the generator 29. However, the use of the output of the multi-pressure radial turbine 25 is not limited to the rotational power source of the generator 29.

FIG. 2 is a T-S diagram of the above-described dual-pressure binary-power generator Bb. In this T-S diagram, a heating medium circulating through the cycle circuit C flows through a dual-pressure Rankine cycle including a high-pressure cycle and a low-pressure cycle.

On one hand, in the high-pressure cycle, a liquid medium is pressurized to the high pressure BH by the high-pressure pump 21H and is heated by the heat radiated when the high-temperature heat source is cooled from the temperature TW1 to the temperature TW2. As a result, the liquid medium is heated to the saturation temperature of the high-pressure heating medium, TH, and is evaporated to form vapor, which is a gaseous medium, at the constant temperature TH. This gaseous medium, in the form of the vapor having the high pressure PH and the high temperature TH, flows into the high-pressure turbine 25H and expands to a turbine outlet pressure Pd, which is the condensing pressure. At this time, the energy of the gaseous medium is converted into rotational power.

On the other hand, in the low-pressure cycle, the liquid medium is pressurized to the low pressure BL by the low-pressure pump 21L and is heated by the heat radiated when the high-temperature heat source is cooled from the temperature TW2 to a temperature TW3 after heating the high-pressure medium. As a result, the liquid medium is heated to the saturation temperature of the low-pressure heating medium, TL, and is evaporated to form vapor, which is a gaseous medium, at the constant temperature TL. This gaseous medium, in the form of the vapor having the low pressure PL and the low temperature TL, flows into the low-pressure turbine 25L and expands to the turbine outlet pressure Pd, which is the condensing pressure. At this time, the energy of the gaseous medium is converted into rotational power.

Because the high-pressure turbine 25H and the low-pressure turbine 25L that constitute these two cycles are formed of one multi-pressure radial turbine 25, their outputs are converted into rotational power by one radial turbine wheel 257, and this power is output to one rotating shaft 255.

Figure 3:
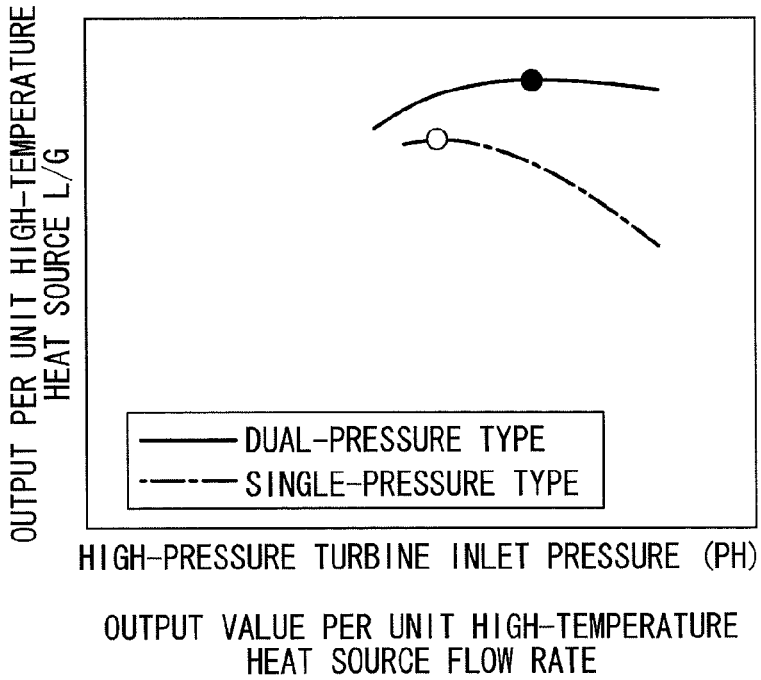
FIG. 3 is a diagram showing the output per unit high-temperature heat source flow rate of the dual-pressure binary-cycle power-generation system, compared with that of a single-pressure counterpart.

FIG. 3 is a diagram of the turbine output value of the dual-pressure binary-cycle power-generation system, showing the output value per unit high-temperature heat source flow rate (L/G) versus the high-pressure turbine inlet pressure PH (horizontal axis). Note that the figure also shows the values for a single-pressure binary-cycle power-generation system with a one-dot chain line.

FIG. 3 shows that the output value of the dual-pressure binary cycle (L/G) is about 10% to 20% higher than that of the single-pressure binary cycle, when their maximum values are compared. Because the dual-pressure binary-power generator Bb is designed to have a pressure that achieves this maximum output value (L/G), when there is a high-temperature heat source having a certain temperature and flow rate, about 10% to 20% higher output than the single-pressure cycle can be achieved by employing the dual-pressure cycle.

Figure 4:
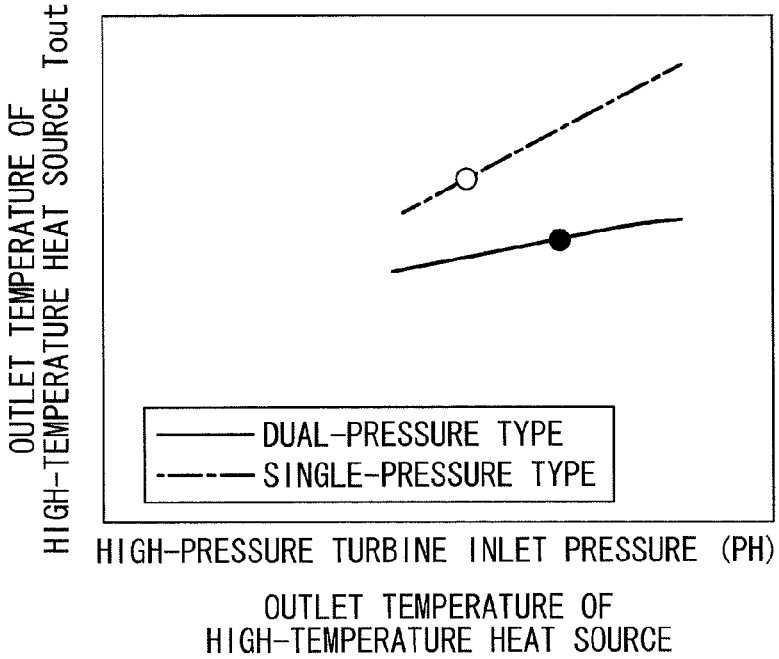
FIG. 4 is a diagram showing the outlet temperature of a high-temperature heat source of the dual-pressure binary-cycle power-generation system, compared with that of a single-pressure counterpart.

FIG. 4 is a diagram of the high-temperature heat source of the dual-pressure binary-cycle power-generation system, showing the outlet temperature TW3 versus the high-pressure turbine inlet pressure (horizontal axis). Note that the figure also shows the values for the single-pressure binary-cycle power-generation system with a one-dot chain line.

FIG. 4 shows that, in the dual-pressure binary cycle, because the outlet temperature of the high-temperature heat source, TW3, shown in FIG. 2, can be reduced, the amount of heat released from the high-temperature heat source may be set to a large value. The turbine output is a product of the temperature difference between the outlet and inlet of the high-temperature heat source and the heat source flow rate and the cycle efficiency of the heating medium Rankine cycle, and FIG. 3 shows this value, expressed as the value per unit heat source flow rate.

In this way, by employing a dual-pressure Rankine cycle, in which a process of releasing heat from one high-temperature heat source is divided into two steps, and a high-temperature region is made to release heat to the high-pressure heating medium in the high-pressure evaporator 23H, and a low-temperature region is made to release heat to the low-pressure heating medium in the low-pressure evaporator 23L, the temperature can be changed to an even lower level than the outlet temperature of the high-temperature heat source in a single-pressure cycle. That is, the above-described dual-pressure Rankine cycle can give a greater amount of the heat energy of the high-temperature heat source to the Rankine cycle than the single-pressure cycle.

Furthermore, in the above-described dual-pressure Rankine cycle, the multi-pressure radial turbine 25 can expand the high-pressure gaseous medium and the low-pressure gaseous medium using one turbine wheel and can output the rotation energy to one rotating shaft. Moreover, because the high-pressure gaseous medium and the low-pressure gaseous medium that have expanded and done work in the multi-pressure radial turbine 25 are merged, the gaseous heating medium (vapor) at the turbine outlet 263 can be guided from one outlet to the condenser 27 on the downstream side thereof.

As described above, because the dual-pressure binary cycle can increase the difference between the inlet temperature and outlet temperature of one high-temperature heat source to increase the released heat power compared with the conventional single-pressure cycle, the percentage of the heat source per unit flow rate convertible into rotation energy can be increased by about 10% to 20%. Accordingly, the dual-pressure binary cycle can extract about 10% to 20% higher rotational power and electric power than the conventional single-pressure cycle, when compared at the same temperature and flow rate of the high-temperature heat source.

Furthermore, when the dual-pressure binary cycle is formed of the conventional turbine, the high-pressure turbine and the low-pressure turbine are needed, so two turbines and two turbine outlets are needed. However, because the dual-pressure cycle employing the multi-pressure radial turbine 25 can extract rotational power from heating media having two pressures using one radial turbine wheel 257 provided on one rotating shaft 255, it may be formed of one rotating shaft 255, the radial turbine wheel 257, and one turbine outlet 263. Thus, a simple system structure becomes possible.

Figure 6:
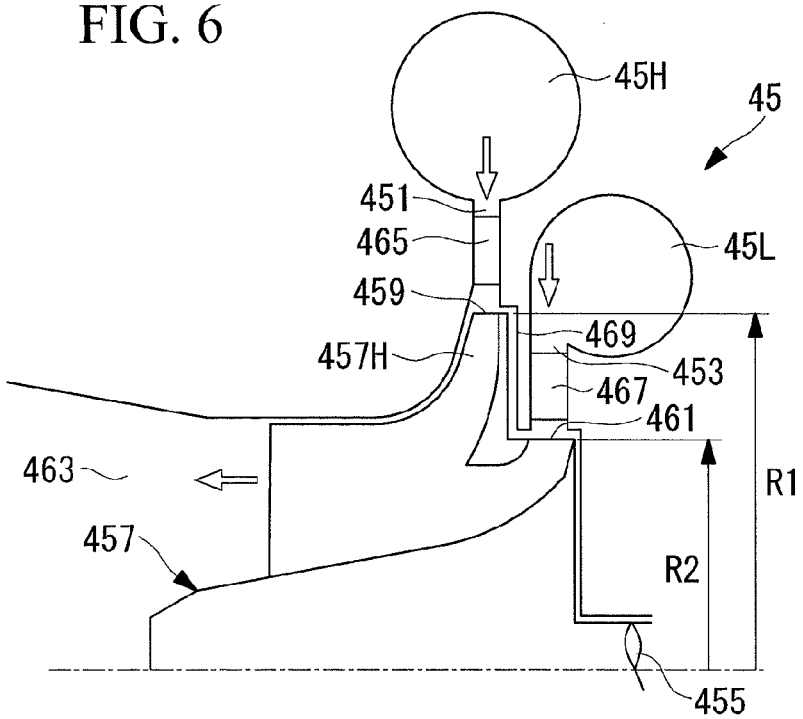
FIG. 6 is a cross-sectional view showing a configuration example of the relevant part (the shape in the meridional plane) of a dual-pressure radial turbine with one rotor blade, serving as a second configuration example of the multi-pressure radial turbine.
Figure 7:
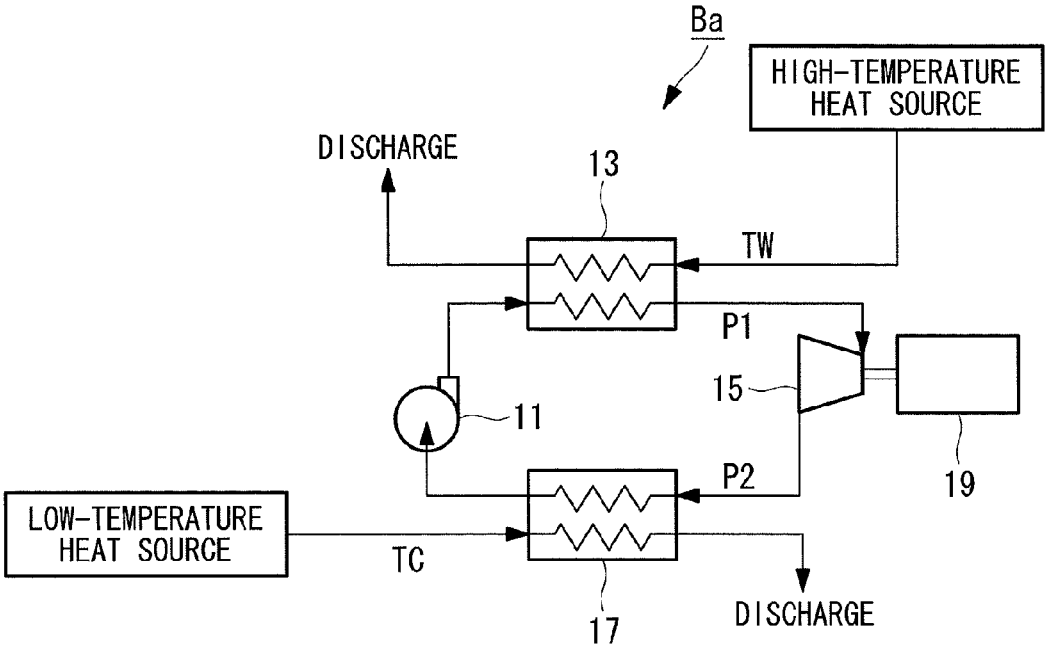
FIG. 7 is a block diagram showing a conventional example of a binary-cycle power-generation system.
Figure 8:
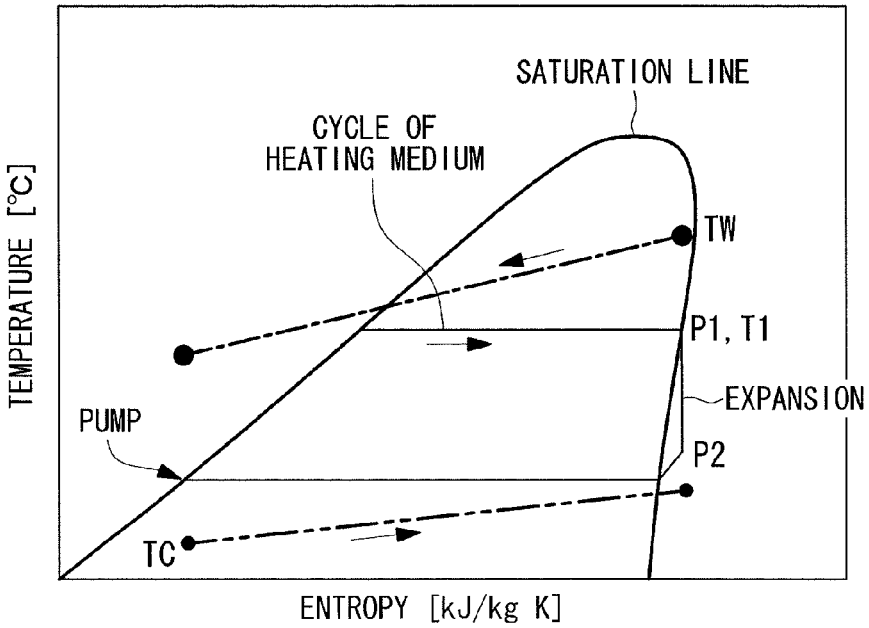
FIG. 8 is a T-S diagram of a heating medium used in the binary-cycle power-generation system shown in FIG. 7.

The above-described multi-pressure radial turbine 25 may employ the structure of a second configuration example, which will be described below on the basis of FIG. 6. In this second configuration example, two gaseous-medium introduction pressures are arranged so as to be gradually increased toward the turbine outlet.

The illustrated multi-pressure radial turbine 45 includes a high-pressure turbine inlet 451 constituting a high-pressure turbine 45H, a low-pressure turbine inlet 453 constituting a low-pressure turbine 45L, and one turbine wheel 457 provided on one rotating shaft 455. Note that the radial turbine wheel 457 may be either a radial turbine wheel or a mixed-flow turbine wheel.

This multi-pressure radial turbine 45 differs from the above-described multi-pressure radial turbine 25 in the configuration in which the high-pressure turbine 45H is disposed on the turbine outlet side (downstream side). In the figure, the reference numeral 459 denotes a high-pressure turbine wheel inlet, 461 denotes a low-pressure turbine wheel inlet, 463 denotes a turbine outlet, 465 denotes a high-pressure nozzle, and 467 denotes a low-pressure nozzle.

In this case, the low-pressure turbine wheel inlet 461 is provided on the opposite side of a backboard 469 of a high-pressure turbine wheel 457H from the turbine outlet 463, via a flow path penetrating the backboard portion of the high-pressure turbine wheel 457H. Furthermore, the radius of the low-pressure turbine wheel inlet 461, R2, is set to a smaller value than the radius of the high-pressure turbine wheel inlet 459, R1 (R2<R1).

Also in this multi-pressure radial turbine 45, the flow rate of the high-pressure gaseous medium flowing from the high-pressure turbine inlet 451 and the flow rate of the low-pressure gaseous medium flowing from the low-pressure turbine inlet 453 are merged, flow out of the turbine outlet 463 of the radial turbine wheel 457, and are guided to the condenser 27 provided on the downstream side thereof, where the heat of the heating medium is released to the low-temperature heat source.

Accordingly, also in the binary power generator employing the multi-pressure radial turbine 45, by employing a dual-pressure Rankine cycle, in which a process of releasing heat from one high-temperature heat source is divided into two steps, and a high-temperature region is made to release heat to the high-pressure heating medium in the high-pressure evaporator 23H, and a low-temperature region is made to release heat to the low-pressure heating medium in the low-pressure evaporator 23L, the temperature can be changed to an even lower level compared with the outlet temperature of the high-temperature heat source in a single-pressure cycle. That is, the above-described dual-pressure Rankine cycle can give a greater amount of the heat energy of the high-temperature heat source to the Rankine cycle than the single-pressure cycle.

Furthermore, in the above-described dual-pressure Rankine cycle, the multi-pressure radial turbine 45 can expand the high-pressure gaseous medium and the low-pressure gaseous medium using one turbine wheel and can output the rotation energy to one rotating shaft. Furthermore, because the high-pressure gaseous medium and the low-pressure gaseous medium that have expanded and done work in the multi-pressure radial turbine 45 are merged, the gaseous heating medium (vapor) at the turbine wheel outlet 463 can be guided from one outlet to the condenser 27 on the downstream side thereof.

Accordingly, the dual-pressure binary cycle using the multi-pressure radial turbine 45 can extract more rotational power and electric power than the conventional single-pressure cycle, when compared at the same temperature and flow rate of the high-temperature heat source.

Furthermore, because the dual-pressure Rankine cycle employing the multi-pressure radial turbine 45 can extract rotational power from heating media having two pressures using one radial turbine wheel 457 provided on one rotating shaft 455, it may be formed of one rotating shaft 455, the radial turbine wheel 457, and one turbine outlet 463. Thus, a simple system structure becomes possible.

In motive-power recovery from exhaust energy discharged in the form of a high-temperature, high-pressure fluid from various industrial plants, in exhaust-heat recovery from systems that obtain motive power via heat cycles of power sources of ships and vehicles, and in motive power recovery in binary cycle generators using a low- or intermediate-temperature fluid heat source, such as geothermal heat/ocean heat energy conversion (OTEC), etc., the above-described multi-pressure radial-turbine generation system is applicable to a power generation system that converts the energy of the low- or intermediate-temperature fluid and the high-temperature, high-pressure fluid used in the above-described systems into rotational power.

Furthermore, although the heating media circulate through the cycle circuit C at two different pressures and temperatures while repeatedly changing their states between liquid and vapor in the above-described embodiment, the heating media may circulate at a plurality of (two or more) different temperatures and pressures.

According to the above-described multi-pressure radial-turbine generation system of this embodiment, a binary cycle having a plurality of (two or more) heating-medium evaporation temperature settings can be achieved with a simple structure. As a result, it is possible to achieve increased efficiency and reduced cost of the binary power generating system.

Note that, the present invention is not limited to the above-described embodiment, and it may be appropriately modified within a scope not departing from the spirit thereof (e.g., the output of the multi-pressure radial turbine may be used to drive a device other than the generator).

REFERENCE SIGNS LIST

21H high-pressure pump
21L low-pressure pump
23H high-pressure evaporator
23L low-pressure evaporator
25, 45 multi-pressure radial turbine
25H, 45H high-pressure turbine

25L, 45L low-pressure turbine
condenser
generator
251, 451 high-pressure turbine inlet
253, 453 low-pressure turbine inlet
255, 455 rotating shaft
257, 457 radial turbine wheel
259, 459 high-pressure turbine wheel inlet
261, 461 low-pressure turbine wheel inlet
263, 463 turbine outlet (turbine wheel outlet)
265, 465 high-pressure nozzle
267, 467 low-pressure nozzle
Bb dual-pressure binary-cycle power-generation system (dual-pressure binary-power generator)
C cycle circuit

The invention claimed is:

1. A multi-pressure radial turbine system comprising:
a closed circuit including:
a plurality of pumps for pressurizing heating media introduced therein to different pressures;
a plurality of evaporators for vaporizing the heating media delivered from the pumps by absorbing heat from a first heat source;
a multi-pressure radial turbine that expands the heating media having different pressures and temperatures, supplied from the evaporators, to obtain output power; and
a condenser for condensing the heating medium expanded in the multi-pressure radial turbine by making the medium release heat to a second heat source having a lower temperature than the first heat source,
wherein the closed circuit is a cycle circuit through which the heating medium circulates while repeatedly changing its state between vapor and liquid, and
wherein the multi-pressure radial turbine includes a turbine wheel that rotates in a casing, the turbine wheel having a plurality of turbine wheel inlets from which the heating media are introduced at different pressures and one turbine wheel outlet from which the expanded heating medium is discharged in an axial direction.

2. The multi-pressure radial turbine system according to claim 1, wherein a flow path of the first heat source connects the plurality of evaporators in series, making the first heat source flow from a high-pressure side to a low-pressure side of the heating media delivered from the pumps.

3. The multi-pressure radial turbine system according to claim 1, wherein the turbine wheel inlets are arranged such that a plurality of heating-medium introduction pressures are gradually lowered toward the turbine wheel outlet.

4. The multi-pressure radial turbine system according to claim 1, wherein the turbine wheel inlets are arranged such that a plurality of heating-medium introduction pressures are gradually increased toward the turbine wheel outlet.

5. The multi-pressure radial turbine system according to claim 1, wherein the multi-pressure radial turbine drives a generator to generate power.

6. A multi-pressure radial turbine system comprising:
a plurality of pumps for pressurizing heating media introduced therein to different pressures;
a plurality of evaporators for vaporizing the heating media delivered from the pumps by absorbing heat from a first heat source;
a multi-pressure radial turbine that expands the heating media having different pressures and temperatures, supplied from the evaporators, to obtain output power; and
a condenser for condensing the heating medium expanded in the multi-pressure radial turbine by making the medium release heat to a second heat source having a lower temperature than the first heat source,
wherein a cycle circuit through which the heating medium circulates while repeatedly changing its state between vapor and liquid is formed, and
wherein the multi-pressure radial turbine includes a turbine wheel that rotates in a casing, the turbine wheel having a plurality of turbine wheel inlets from which the heating media are introduced at different pressures and a turbine wheel outlet from which the expanded heating medium is discharged in an axial direction, and
the turbine wheel expands the heating medium having different pressures introduced from the plurality of the turbine wheel inlets and discharges the expanded heating medium from the turbine wheel outlet.

7. The multi-pressure radial turbine system according to claim 1, wherein the heating medium is an organic medium.

8. A binary cycle generator system including the multi-pressure radial turbine system according to claim 1, wherein geothermal heat is used as the first heat source.

9. A power recovery system including; a plant; and
the multi-pressure radial turbine system according to claim 1, wherein exhaust energy discharged from the plant is used as the first heat source.

10. An exhaust-heat recovery system including; a power source; and
the multi-pressure radial turbine system according to claim 1, wherein exhaust energy discharged from the power source is used as the first heat source.

11. A pump provided in a closed circuit having a plurality of evaporators for vaporizing a liquid-phase heating media by absorbing heat from a first heat source; a multi-pressure radial turbine for expanding the heating media having different pressures and temperatures, supplied from the evaporators, to obtain output power; and a condenser for condensing the heating medium expanded in the multi-pressure radial turbine by making the medium release heat to a second heat source having a lower temperature than the first heat source are provided, the pump being arranged between the condenser and the plurality of evaporators and pressurizing the heating media from the condenser to different pressures,
wherein the closed circuit is a cycle circuit through which the heating medium circulates while repeatedly changing its state between vapor and liquid, and
wherein the multi-pressure radial turbine includes a turbine wheel that rotates in a casing, the turbine wheel having a plurality of turbine wheel inlets from which the heating media are introduced at different pressures and one turbine wheel outlet from which the expanded heating medium is discharged in an axial direction.

12. An evaporator provided in a closed circuit having a multi-pressure radial turbine for expanding heating media having different pressures and temperatures to obtain output power, a condenser for condensing the heating medium expanded in the multi-pressure radial turbine by making the medium release heat to a first heat source, a plurality of pumps for pressurizing the heating media from the condenser to different pressures, the evaporator vaporizing the heating media delivered from one of the pumps by absorbing heat from a second heat source having a higher temperature than the first heat source,
wherein the closed circuit is a cycle circuit through which the heating medium circulates while repeatedly changing its state between vapor and liquid, and wherein the multi-pressure radial turbine includes a turbine wheel that rotates in a casing, the turbine wheel having a plurality of turbine wheel inlets from which the heating media arc introduced at different pressures and one turbine wheel outlet from which the expanded heating medium is discharged in an axial direction.

13. A multi-pressure radial turbine provided in a closed circuit having a condenser for condensing heating medium by making the medium release heat to a first heat source; a plurality of pumps for pressurizing the heating media from the condenser to different pressures; a plurality of evaporators for vaporizing the heating media delivered from the pumps by absorbing heat from a second heat source having a higher temperature than the first heat source, the multi-pressure radial turbine expanding the heating media having different pressures and temperatures, supplied from the evaporators, to obtain output power, wherein the closed circuit is a cycle circuit through which the heating medium circulates while repeatedly changing its state between vapor and liquid, and wherein the multi-pressure radial turbine includes a turbine wheel that rotates in a casing, the turbine wheel having a plurality of turbine wheel inlets from which the heating media are introduced at different pressures and one turbine wheel outlet from which the expanded heating medium is discharged in an axial direction.

14. A power generation method comprising:

pressurizing heating media to different pressures;

vaporizing the heating media absorbing heat from a first heat source;

expanding the heating media having different pressures and temperatures to obtain output power; and condensing the heating medium by making the medium release heat to a second heat source having a lower temperature than the first heat source, wherein the heating media circulates through a closed circuit while repeatedly changing its state between vapor and liquid.

* * * * *